US005240431A

United States Patent [19]

Yagi et al.

[11] Patent Number: 5,240,431

[45] Date of Patent: Aug. 31, 1993

[54] WATERPROOF CONNECTOR

[75] Inventors: Sakai Yagi; Kimihiro Abe; Seiji Koumatsu, all of Shizuoka, Japan

[73] Assignee: Yazaki Corporation, Japan

[21] Appl. No.: 911,049

[22] Filed: Jul. 9, 1992

[30] Foreign Application Priority Data

Jul. 10, 1991 [JP] Japan ..... 3-53447[U]

[51] Int. Cl.[5] ..... H01R 13/52

[52] U.S. Cl. ..... 439/271; 439/283

[58] Field of Search ..... 439/271-283, 439/587

[56] References Cited

U.S. PATENT DOCUMENTS 4,395,085 7/1983 Inoue ..... 439/271
4,486,062 12/1984 Kasugai ..... 439/271
5,104,253 4/1992 Zielinski et al. ..... 439/271

FOREIGN PATENT DOCUMENTS 2-49657 12/1990 Japan .

*Primary Examiner*—David L. Pirlot
*Attorney, Agent, or Firm*—Venable, Baetjer, Howard & Civiletti

[57] ABSTRACT

A waterproof connector includes a female connector housing and a cylindrical packing holder. The female connector housing has a peripheral edge of an opening through which a male connector housing is inserted. The packing holder has a peripheral edge of an opening. This peripheral edge contacts the inside of the peripheral edge of the opening in the female connector housing. The peripheral edge of the opening in the packing holder has end portions formed by partially cutting the packing holder. Recesses are formed in the end portions on the peripheral edge of the opening in the packing holder. Projections are formed on portions of the female connector housing, which portions correspond to the end portions of the packing holder. The projections are fitted into the recesses so as to join the packing holder and the female connector housing. When the packing holder is inserted into the female connector housing, the peripheral edge of the opening in the packing holder is joined integrally with the peripheral edge of the opening in the female connector housing. Thus, when the male connector is fitted, it is mated smoothly with the female connector housing without causing the end portions of the peripheral edge of the packing holder to hinder mating.

3 Claims, 2 Drawing Sheets

WATERPROOF CONNECTOR

BACKGROUND INVENTION

1. Field of the Invention

The present invention relates to a waterproof connector used for wiring in a vehicle, such as an automobile, and more particularly, to the structure of a female connector housing with a packing holder.

2. Description of the Related Art

A conventional waterproof connector is disclosed in Japanese Unexamined Utility Model Publication No. 61-11387. In this type of connector a waterproof packing is accommodated in a female connector housing, and a packing holder is inserted into the female connector housing to support the waterproof packing, and then a male connector housing is fitted in the packing holder so that the male and female connector housings are mated. In such a waterproof connector, the male connector housing is provided with a lock projection, whereas the female connector housing is provided with a lock arm which engages with the lock projection so as to fix the male and female connector housings when they are mated. The packing holder has an opening for inserting the male connector and an open portion for passing the lock projection of the male connector housing. The periphery of the opening of the packing holder is partially cut away by the open portion, and two ends are defined. In such a structure, the ends of peripheral edge of the packing holder tend to change the shape, for example, the peripheral edge bends inward when it is molded or due to changes with time. When the male connector housing is fitted in the packing holder, an insertion end of the male connector housing touches the peripheral edge of the packing holder, thus making it impossible for the male connector housing to be fitted in the packing holder.

The present invention solves the above problem, and the object thereof is to provide a waterproof connector which prevents a male connector housing from touching a packing holder when the male connector is fitted in the packing holder so that no poor fitting occurs.

SUMMARY OF THE INVENTION

To achieve the above object, this invention provides a type of waterproof connector in which a waterproof packing is accommodated in a female connector housing, and a packing holder is inserted into the female connector housing to support the waterproof packing, and then a male connector housing is fitted in the packing holder. In the above waterproof connector, engaging means are provided at both ends of the periphery of an opening of the packing holder which is formed by partially cutting the periphery edge to advance the male connector housing through the packing holder, and on the portions of the periphery of an opening in the female connector housing, through which the male connector housing is inserted. These portions of the periphery oppose to the ends of periphery of the packing holder.

In accordance with the above structure, when the packing holder is inserted into the female connector housing, engaging members formed on the peripheral edge of the packing holder engage with other engaging members formed on the periphery of the opening in the female connector housing. Thereby, the ends of peripheral edge of the packing holder is secured to the periphery of the opening in the female connector housing. Deformations caused when the packing holder is molded are corrected, and no deformations are caused by the passage of time.

The preferred embodiment of this invention will be described below with reference to the accompanying drawings.

DESCRIPTION OF THE PREFERRED EMBODIMENT

Figure 1:
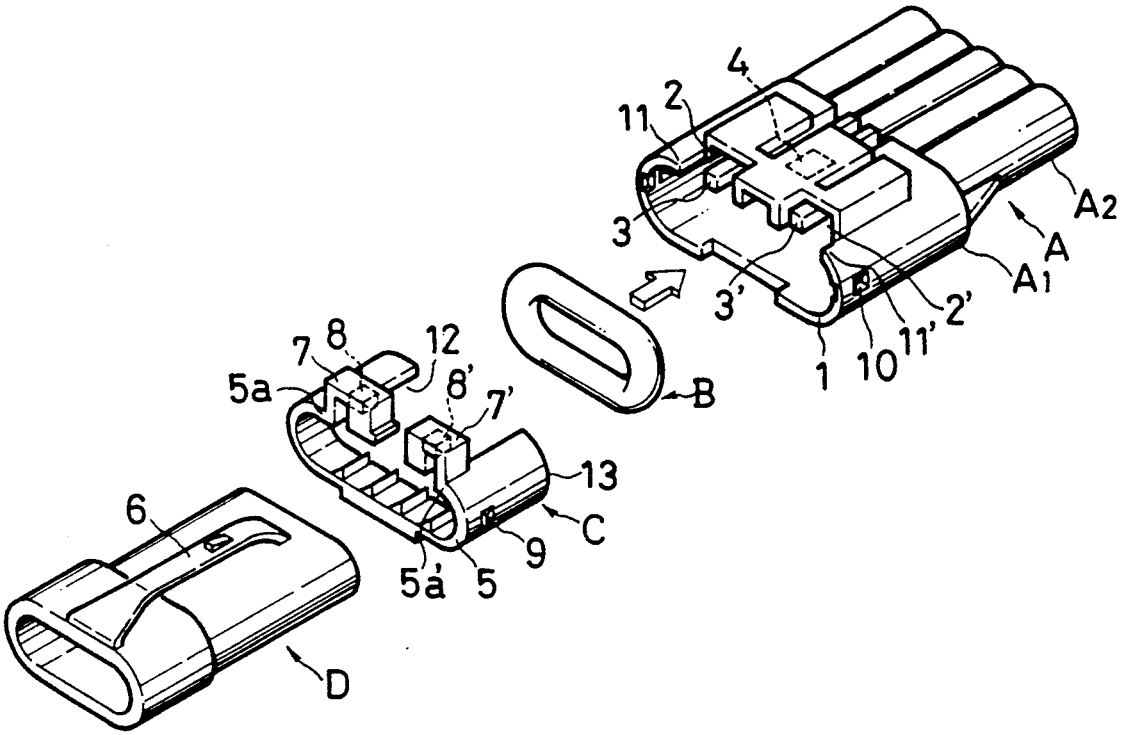
FIG. 1 is an exploded perspective view showing preassembled male and female connector housings, a waterproof packing and a packing holder, all of which constitute the waterproof connector of this invention.

Referring to FIG. 1, a waterproof connector of the present invention is assembled in the following manner. A waterproof packing B is accommodated in a female connector housing A, and a packing holder C is inserted into the female connector housing A to support the waterproof packing B, and then a male connector housing D is fitted into the packing holder C. The female connector housing A has an electric wire connecting portion $A_2$ and a hollow cylindrical portion $A_1$ in which the male connector housing D is accommodated. The hollow cylindrical portion $A_1$ has the periphery 1 of an opening through which the male connector housing D is inserted. The periphery 1 of the opening is cut out at end portions 11 and 11' to form engaging portions 2 and 2'. The end portions 11 and 11' oppose to other end portions 5*a* and 5*a'* of the packing holder C, which will be described later. Engaging projections 3 and 3' extend from the engaging portions 2 and 2' toward the direction in which the packing holder C is fitted. A lock engaging member 4 is formed on the upper part of the hollow cylindrical portion $A_1$. The lock engaging member 4 is used for fixing the male connector housing D when it is inserted. Holes 10 for retaining the packing holder C are formed on both sides of the hollow cylindrical portion $A_1$.

The packing holder C is cylindrically shaped so as to contact with the inside of the portion $A_1$ of the female connector housing A. The male connector housing D is provided with a lock arm 6 which engages the lock engaging member 4 formed on the portion $A_1$ of the female connector housing A so as to fix the male and female connectors. The packing holder C has a periphery 5 of an opening which contacts the periphery 1 of the opening in the female connector housing A when the packing holder C is attached to the portion $A_1$. The male connector is fitted in the packing holder C through the periphery 5. The packing holder C has an open portion 12 which is formed by cutting the upper central portion of the periphery 5 at right angles. Thus, the periphery 5 is provided with end portions 5*a* and 5*a'* on both ends of the open portion 12. The end portions 5*a* and 5*a'* are provided with engaging portions 7 and 7', which oppose to the engaging portions 2 and 2' of the female connector housing A, respectively. Recesses 8 and 8' for engagement purposes are formed in inserting direction in the engaging portions 7 and 7', respectively. Projections 9 are formed on both sides of the packing holder C. When the packing holder C is inserted into the female connector housing A, the projections 9 engage with the retaining holes 10 formed in the cylindrical portion $A_1$ so as to fix the female connector housing A. When the packing holder C is inserted into the female connector housing A, the waterproof packing B is retained by a retaining edge 13 opposite the periphery 5.

Figure 2:
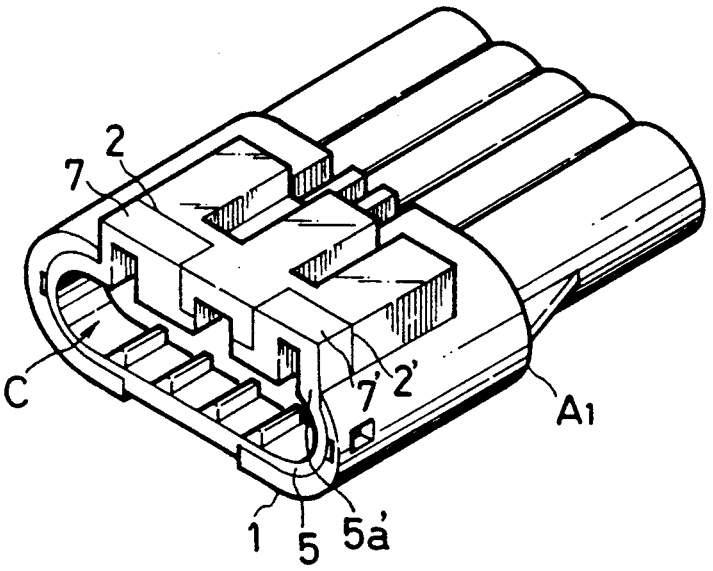
FIG. 2 is a perspective view showing the female connector housing to which the packing holder is attached.

The above-described female connector housing A, waterproof packing B and packing holder C are assembled in the following way. First, as shown by the arrow in FIG. 1, the waterproof packing B is accommodated in the female connector housing A. Then, the packing holder C is inserted into the hollow cylindrical portion $A_1$, and the retaining edge 13 is pressed into contact with the waterproof packing B so as to hold the packing B. The engaging projections 3 and 3' of the cylindrical portion $A_1$ are fitted into the engaging recesses 8 and 8' in the packing holder C. At the same time, the projections 9 are fitted into the holes 10, whereby the packing holder C is secured to the female connector housing A. FIG. 2 is a perspective view showing a completely assembled waterproof female connector housing.

In the embodiment described above, the recesses 8 and 8' for engaging purposes are formed in the engaging portions 7 and 7' of the packing holder C. Projections may be used instead of the recesses 8 and 8', and recesses may be used instead of the engaging projections 3 and 3' of the female connector housing A so that these projections are fitted into the recesses.

According to this invention, when the packing holder is inserted into the cylindrical portion of the female connector housing, the peripheries of the openings in both components, through which the male connector housing is inserted, are integrally joined. Therefore, there is no play between the packing holder and the female connector housing, and the male connector housing can be smoothly mated with the female connector housing, thereby preventing poor mating.

What is claimed is:

1. A waterproof connector, comprising:

a male connector housing;

a female connector housing having a hollow cylindrical portion with an opening for receiving said male connector housing and a peripheral edge defining said opening;

a waterproof packing to be accommodated in said female connector housing;

a cylindrical packing holder to be inserted into said cylindrical portion of said female connector so as to retain said waterproof packing inside said female connector housing, said cylindrical packing holder having a peripheral edge that defines an opening and which contacts an internal surface of said peripheral edge of said female connector housing when said packing holder is inserted into said said female connector housing, said peripheral edge of said packing holder having two ends formed on opposing sides of a cut provided in said peripheral edge of said packing holder; and engaging means for joining said packing holder and said female connector housing, said engaging means including a first pair of engaging members provided on respective said ends of said peripheral edge of said packing holder and a second complementary pair of engaging members provided on a portion of said peripheral edge of said female connector housing that is in opposing relation to said first pair of engaging members;

wherein at least one of either said first engaging members or said second engaging members is in the form of a projection and at least one of the other of said first engaging members or said second engaging members has a recess for receiving said projection.

2. A waterproof connector, comprising:

a male connector housing having a lock member;

a female connector housing having a hollow cylindrical portion with an opening for receiving said male connector housing and a peripheral edge defining said opening, said female connector housing further having a lock engaging member that cooperates with said lock member when said male connector housing is inserted in said female connector housing;

a waterproof packing to be accommodated in said female connector housing;

a cylindrical packing holder to be inserted into said cylindrical portion of said female connector so as to retain said waterproof packing inside said female connector housing, said cylindrical packing holder having a retaining end for retaining said waterproof packing in said female connector housing, and a peripheral edge that defines an opening for receiving said male connector housing, said peripheral edge of said packing holder contacting an internal surface of said peripheral edge of said female connector housing when said packing holder is inserted into said said female connector housing, wherein said peripheral edge of said packing holder has a central opening through which said lock member of said male connector housing passes and two ends formed on opposing sides of said central opening;

first engaging means provided on said ends of said peripheral edge of said packing holder for joining said packing holder and said female connector housing; and second engaging means provided on portions of said peripheral edge of said female connector housing opposite said ends of said peripheral edge of said packing holder for engaging said first engaging means and joining said packing holder and said female connector housing;

wherein said first engaging means comprises extension members extending from respective ones of said ends of said peripheral edge of said packing holder, each said extension member having a recess formed therein, and said second engaging means comprises cut-away portions that are in opposing relation to said extension members and are each provided with a projection to be received in respective ones of said recesses.

3. A waterproof connector, comprising:

a female connector housing having a hollow cylindrical portion with an opening for receiving said male connector housing and a peripheral edge defining said opening; and a cylindrical packing holder to be inserted into said cylindrical portion of said female connector so as to retain said waterproof packing inside said female connector housing, said cylindrical packing holder having a retaining end for retaining a waterproof packing in said female connector housing, and a peripheral edge that defines an opening and which contacts an internal surface of said peripheral edge of said female connector housing when said packing holder is inserted into said said female connector housing, said peripheral edge of said packing holder having two ends formed on opposing sides of a cut provided in said peripheral edge of said packing holder;

wherein said packing holder includes first engaging means provided on said ends of said peripheral edge of packing older, and said female connector housing includes second engaging means provided on portions of said female connector housing opposite said ends of said peripheral edge of said packing holder; and wherein said first engaging means comprises extension members extending from respective ones of said ends of said peripheral edge of said packing holder, each said extension member having a recess formed therein, and said second engaging means comprises cut-away portions that are in opposing relation to said extension members and are each provided with a projection to be received in respective ones of said recesses.

* * * * *